US007815133B2

(12) United States Patent
Belotserkovsky

(10) Patent No.: US 7,815,133 B2
(45) Date of Patent: Oct. 19, 2010

(54) METHOD FOR CONTROLLING PROCESS PARAMETERS OF A CONE CRUSHER

(75) Inventor: Konstantin Evseevich Belotserkovsky, St. Petersburg (RU)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/524,485

(22) PCT Filed: Jan. 22, 2008

(86) PCT No.: PCT/RU2008/000026

§ 371 (c)(1),
(2), (4) Date: Sep. 4, 2009

(87) PCT Pub. No.: WO2008/097128

PCT Pub. Date: Aug. 14, 2008

(65) Prior Publication Data

US 2010/0102152 A1 Apr. 29, 2010

(30) Foreign Application Priority Data

Jan. 31, 2007 (RU) ..... 2007105019

(51) Int. Cl.
*B02C 25/00* (2006.01)
*B02C 4/30* (2006.01)
*B02C 2/00* (2006.01)

(52) U.S. Cl. ..... 241/30; 241/37; 241/207

(58) Field of Classification Search ..... 241/30, 241/37, 207–216

See application file for complete search history.

(56) References Cited

U.S. PATENT DOCUMENTS 4,793,560 A * 12/1988 Schrodl ..... 241/30

(Continued)

FOREIGN PATENT DOCUMENTS

GB 1185447 3/1970

(Continued)

OTHER PUBLICATIONS

L.A. Vaisberg et al., "Studies of Methods for Controlling Process Factors of Cone Inertial Crushers," Vibratory Crushers, Vsegei Publishers, Saint-Petersburg, Chapter 9, 2004, pp. 128-140.

*Primary Examiner*—Faye Francis
(74) *Attorney, Agent, or Firm*—Drinker Biddle & Reath LLP

(57) ABSTRACT

A crushing and reducing device, especially cone crushers, used in the building and ore-dressing industries. A method includes providing a crusher with proximity sensors and a disc rigidly secured to the unbalanced-mass vibration generator of the crusher such that the plane thereof is always perpendicular to the rotation axis of the vibration generator. The method includes measuring a distance to the disc, calculating the three-dimensional position of the disc plane, calculating the amplitude of the circular vibrations of the internal cone according to the position, calculating the size of a crushing gap according to the calculated amplitude, comparing the size with the specified parameter of the gap and, if required based on comparison results, outputting a control command to hydraulic cylinders to modify the position of an adjustment ring. The adjustment ring position is controlled by a proximity sensor which is mounted on the flange of a body top part.

4 Claims, 3 Drawing Sheets

U.S. PATENT DOCUMENTS

| | | | | |
|---|---|---|---|---|
| 5,575,428 | A | 11/1996 | Cordonnier et al. | |
| 6,513,738 | B1 * | 2/2003 | Braun et al. | 241/30 |
| 6,981,665 | B2 * | 1/2006 | Braun et al. | 241/30 |
| 7,360,726 | B2 * | 4/2008 | Nilsson et al. | 241/30 |
| 7,673,821 | B2 * | 3/2010 | Norrman et al. | 241/15 |

FOREIGN PATENT DOCUMENTS

| | | |
|---|---|---|
| RU | 2 058 818 | 4/1996 |
| RU | 2 078 612 | 5/1997 |
| RU | 2 211 089 | 8/2003 |
| SU | 196536 | 7/1967 |
| SU | 458335 | 1/1975 |
| SU | 915320 | 12/1979 |
| SU | 808152 | 2/1981 |

* cited by examiner

METHOD FOR CONTROLLING PROCESS PARAMETERS OF A CONE CRUSHER

The invention relates to crushing and reducing equipment, in particular to cone crushers, and can be used in the building, mining and ore-dressing industries.

Modern crushing installations are machines complex and expensive in exploitation. One of the most impotent problems is the possibility to trace all operation parameters with a high accuracy, maintain said parameters within predetermined limits, and also predict and prevent emergency situations. When one crusher is out of order, this usually results in failure of all process sequence of the ore mining and processing enterprise, said crusher being an element of said sequence/

Designs of crushers are known for a long time and described in literature. For example, the book VIBRATORY CRUSHERS by Vaisberg, L. A., et al., VSEGEI Publishers, Saint-Petersburg, 2004, contain Chapter 9 "Studies of Methods for Controlling Process Factors of Cone Inertial Crushers," pages 128 to 140.

There are two cones—internal and external—in cone crushers. The process of crushing a source material takes place in a crushing chamber between the cones and is accompanied with quick wear of working surfaces of both cones. Therefore, continuous monitoring of compensation for wear of cones by adjusting a distance—a discharge gap—between the cones allows stabilization of optimal process parameters, presence of a finished product of predetermined grading at the output, and improvement in the operation productivity of the installation.

It is not the first year when the inventor deals with this problem. Particularly, the inventor together with other inventors has devised and patented "Cone Inertial Crusher" in 1993, said crusher having the higher reliability due to the possibility of smooth adjusting a swing amplitude of an inner crushing cone, see Patent RU 2,058,818, the priority as of Apr. 13, 1993, IPC(6) B02C 2/02.

Developments of other inventors in this direction are known as well.

For example, known is Patent RU 2,078,612, IPC(6) B02C 2/02, having the Convention priority date as of Mar. 24, 1993, International Application publication PCT/FR 94/00,309, "CONE-TYPE VIBRATING CRUSHER AND METHOD FOR ADJUSTING OPERATION OF SUCH CRUSHER."

According to this invention, a cone of the crusher is mounted on its support in such a way as to rotate freely and is provided with means for measuring the rotation speed thereof about its axis functionally connected with a system for adjustment of the frequency and amplitude of the vibrations of the cup, and to a system for adjustment the position of the cone along the height relative to the cup. If the rotation speed of the cone is known, it is possible to determine a material layer thickness in a pane of discharge of crushed materials for a predetermined adjustment (a width of an annular gap in the pane of discharge of crushed materials) of the crusher, and if necessary, to change said thickness by adjusting a frequency and/or amplitude of means providing vibration of the cup, and/or a position along the height of the cone in order to obtain a crushed product having a desired grading, wherein said means allow automation of the crusher operation. From the other hand, for the predetermined frequency and amplitude of the means causing the cup vibration and the width of the discharge gap, evolution of the rotation speed of the cone makes it possible to detect wear of working surfaces of the cone and the cup.

The method for adjusting operation of this crushers includes measuring the rotation speed of the cone around its axis in order to determine a minimum thickness of a material on a crushed material discharge plane (level) based on a measure value of the rotation speed of the code and the width of the annular gap present in this plane between the cone and the cup when the crusher is in a quiescent state, and to adjust parameter of means causing vibrations of the cup and/or positions along the height of the cone relative to the cup for maintaining the minimum material layer thickness equals to a predetermined value.

Known is "METHOD FOR PRESERVATION OF CONE INERTIAL CRUSHER FROM GOING TO EMERGENCY MODE," see the USSR Inventor's Certificate No 915,320 having the priority as of Dec. 14, 1979, IPC(3) B02C 2/00, 25,00. The method comprises monitoring a value of a rated current consumed by an electrical motor of a crusher drive followed by stopping a crusher when the rated current in an electrical motor circuit is exceeded, and is characterized by stopping the crusher when a movable cone increases an amplitude up to more than 30% at not less than its three-fold coincidence for 10 to 15 sec with increase of a rated current value. Coincidence of said parameters is transmitted by a comparator to a command unit which gives a signal for turning the crusher off.

The closest one from the technical point of view is a method of operating "APPARATUS FOR ADJUSTING DISCHARGE GAP OF INERTIAL CRUSHER," see USSR Inventor's Certificate No 458,335 having the priority as of Sep. 14, 1973, IPC B02C 25/00, 2/00. The apparatus comprises: a drive with a ball spindle whose lower head is mounted in a bearing; hydraulic cylinders for adjusting a discharge gap; and a discharge gap meter. The apparatus is characterized in that the meter is embodied as inductive sensors positioned over 90° around the ball spindle in an annular cassette secured in a bearing bore. When the hall spindle rotates, unbalance creates a centrifugal force that biases an axis of an internal movable cone from a crusher vertical. A value of an angular acceleration of the spindle from its axis depends upon a size of the discharge gap between cones. An amplitude of a spindle movement in a plane of the inductive sensors is recorded by inspection equipment which adjust operation of the hydraulic cylinders which provide lifting or lowering of the external cone thereby to adjust the size of the discharge gap.

All method listed above have similar disadvantages being as follows:

the low accuracy of measurements and the low speed of measurements;

the need to stop operation of the crushing installation in order to make some measurements and adjustments—modifications of process parameters;

the size of the discharge gap between the external and internal cones is a basic subject for measurements which is not a direct but an indirect factor having an influence upon process parameters of the installation;

the influence of "the human factor" during manual measurements and—as a consequence—increase of the possibility of errors;

the finished product has an non-uniform fineness.

It is an object of the present invention to provide such a method for controlling operation of a crushing installation which could allow:

- measurement and modification—in a continuous operation mode as quickly as possible and as fast as possible—of main process parameters directly affecting the quality and performance of machine operation;
- prevention malfunctions in operation and emergency situations with a high degree of probability;

presence of the fullest monitoring of the crusher state at any time, thereby making it possible to efficiently use and to extend the service life of the wording surfaces;

introduction of automated computerized control thereby excluding a human factor from the process of measurements and adjustments.

Further, it is important to have the possibility to accumulate and systematize statistical data of modifying process parameters in oration with different source materials or under different environment conditions in order to introduce the mathematical prediction of in-time substitution of the machine working assemblies.

At the same time, all said problems should be solved using simple and reliable apparatuses because the crushers usually operate under complex field conditions of a producing open-cut mine, in ore mining and processing enterprises, under extreme north conditions, etc.

Solution of the Problem

One of main process parameters of a crushing installation is an amplitude of circular oscillations of an internal cone. For aims of the present Specification, let us take that an amplitude of internal cone oscillations is the most angle of cone deviation from a vertical axis of a crusher. Modification of the amplitude is a consequence of modifying a size of a discharge gap. In turn, the amplitude is affected by a size and strength of a source material, an unbalance rotation frequency, an unbalance degree.

Therefore, the possibility to adjust the amplitude of circular oscillations of the internal con in both operation mode and idle mode allows control of operation of the machine as a whole.

Said object is accomplished as follows.

A method for controlling process parameters of a cone crusher comprises:

providing the crusher with sensors;

estimating a size of a discharge gap between external and internal cones;

adjusting the size of the discharge gap using hydraulic cylinders modifying a position of the external cone relative to the internal cone by means of a adjustment ring.

The method is characterized by:

using sensors measuring a distance as said sensors;

controlling the operation of all sensors mounted on the crusher by a program algorithm of a central computer;

rigidly securing a measurement disc R to an unbalanced vibrator in such a manner that a plane of the disc R is always perpendicular to a rotation axis of the unbalanced vibrator, mounting at least two distance measurement sensors on a body of the crusher in such a manner that the disc R in any time is within a working effective zone of the distance sensors;

measuring a distance from each of the measurement sensors to the disc R and calculating a three-dimensional position of the plane of the disc R, wherein an angle & of deviation of the plane of the disc R from horizontal determines an angle &' of deviation of the internal cone from vertical according to which an amplitude of circular oscillations of the internal cone is determined;

determining the size of the discharge gap from the amplitude of circular oscillations;

comparing the obtained size of the discharge gap to a predetermined parameter of the gap in the central computer;

if correction of parameters is necessary as a result of comparisons, outputting a control command to the hydraulic cylinders by the central computer to modify a positions of the adjustment ring;

as the discharge gap achieves the predetermined parameter, outputting a control command to the hydraulic cylinders by the central computer to stop modification of the position of the adjustment ring;

monitoring the modification of the position of the adjustment ring using at least one distance monitoring sensor which is mounted at a flange of a top part of the body within an opening between the flange of the body and a flange of the adjustment ring of the external cone;

measuring a distance S between the flange of the body and the flange of the adjustment ring and supplying information to the central computer and comparing it to previous measurements;

simultaneously, by the central computer, monitoring a wear of working surfaces of the cones in such a manner that a minimum wear corresponds to a minimum value of the S while a maximum wear corresponds to a maximum value of the S, and outputting a command to stop operation and replace the cones when the S achieves a critical value;

simultaneously, by the central computer, monitoring a spontaneous turn of the adjustment ring that shows an unauthorized variation of the distance S because of relaxing a thread tension.

All said measurements take place continuously, cyclically, in the operation mode, in the idle mode, and in the quiescent state.

Additional distinctions of the method are as follows.

The method is implemented with the most effect if the measurement disc R is fastened to an end face of a casing of a sliding bearing in the unbalanced vibrator of the cone crusher in such a manner that the plane of the disc R is parallel to a plane of a base of the internal cone.

Ultrasonic and/or laser sensors are the most effective as the distance sensors.

The distinguishing features of the method allow:

achievement the high accuracy of measurements limited only by the operation quality of the distance sensors;

dynamical monitoring of the size of the oscillation amplitude of the internal cone; this parameter allows better determination of the size of the discharge gap, and making a correction by comparing the resulted size to an optimum value stored in the central computer;

limitation of the correction speed only by a quickness of the hydraulic cylinder operation;

high quality of implementing the method is provided by a computer analysis of data.

Figure 1:
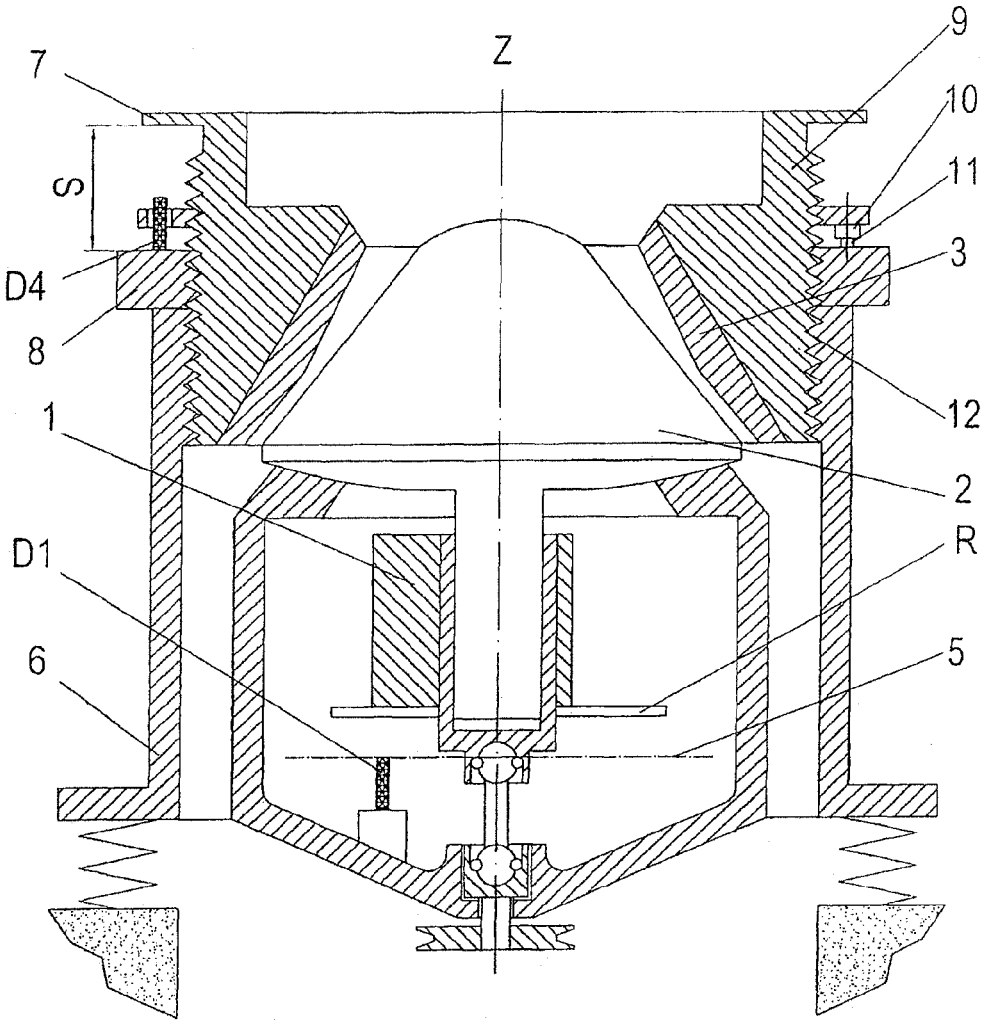
FIG. 1 represents a cone inertial crusher having a classic design modernized to implement the claimed method.

The method can be practiced on the basis of the classic design of the cone crusher.

Any sensors known from the prior art can be used as distance sensors, for example, ultrasonic sensor having a range from 30 to 300 mm and capable of being synchronized and programmed for joint operation. For example, there are US300-30GM-IUR2-V15 sensors available from PEPPERL+FUSHC (DE). Said sensors irradiate pulses in a cyclic mode. Said pulses are reflected from a surface of an object present in "the working effective zone," and a distance to the object to be monitored is determined from a rime of returning pulses back to a sensor. Let us consider an example using three measurement sensors because the inventor deems this variant the most optimal since a position of a plane in space is determined using three points.

The purpose of the disc R is "a measurement plane;" said disc is rigidly secured perpendicularly to the rotation axis at the end face of the body of the sliding bearing in the unbalanced vibrator q and thus repeats all moves of the vibrator and therefore of the internal cone 2 associated therewith as well.

In the present example, the sensors D 1, 2 and 3 are mounted below a level of the measurement disc, for example in the bottom of the body 6 in a housing of the crusher, in such a manner that the disk R is in the working zone of radiation of the sensors D (FIG. 2) in any time including a time of a maximum unbalance deviation from the axis X.

An ultrasonic pulse (USP) sent from a working end face of any sensor should be directed upwardly along the vertical axis Z of the crusher.

A monitoring sensor D 4 is mounted at any point of a circle on the flange 8 of the body top part between the flange of the body 6 and a flange of the adjustment ring 7 of the external cone 3.

Operation of all sensors is synchronized and controlled by the central computer

A Cycle of Measurements

Figure 2:
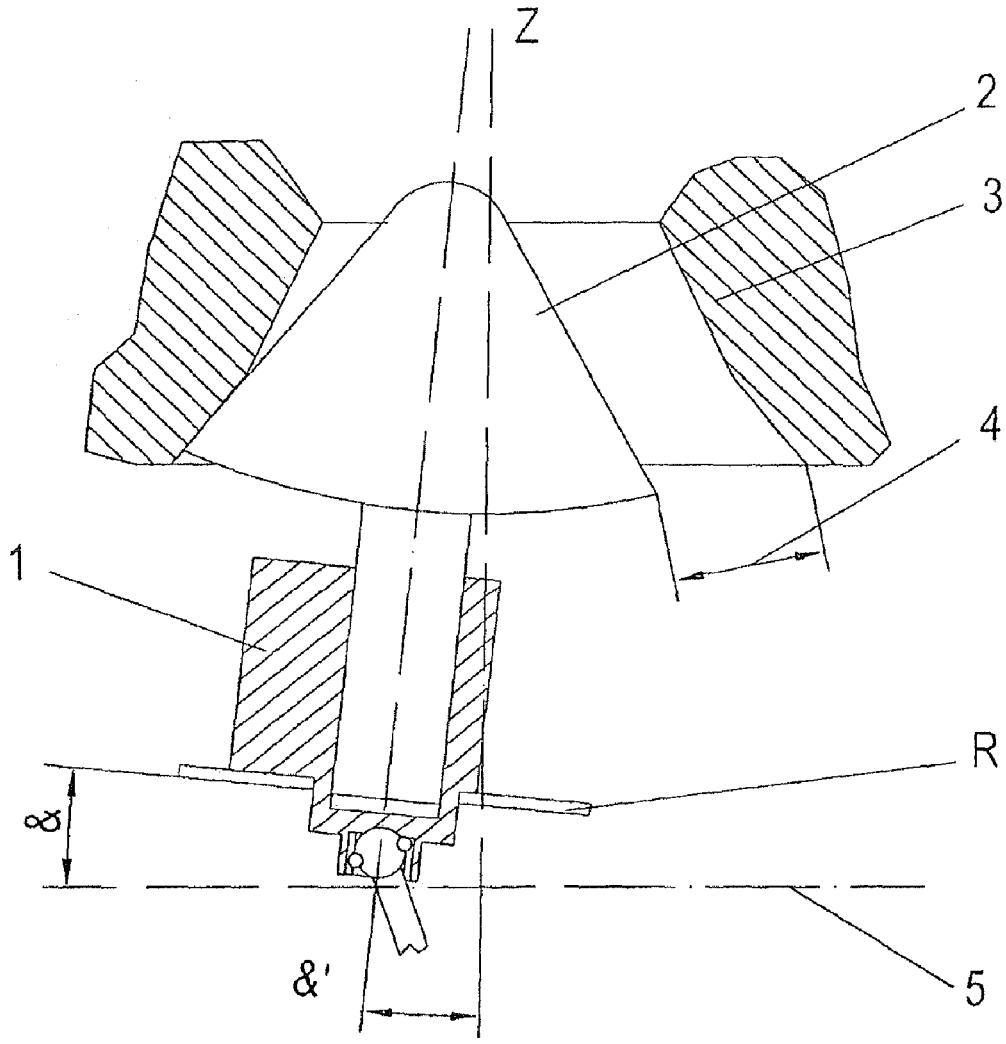
FIG. 2 shows a scheme of the relationship between an angle & of deviation of the disc R plane from horizontal and an angle &' of deviation of the internal cone from vertical.

The sensors D 1, 2 and 3 simultaneously radiate USRs reflected from the disc R. Distances to three different points on the disc R are determined from a return time, and information is transmitted to the central computer that is guided by said three point to calculate a three-dimensional position of the plane of the disc R relative to the horizontal plane. An angle & of deviation of the plane of the disc R from horizontal equals to an angle &' of deviation of the internal cone from vertical plane, because they are the angle formed by orthogonal lines, wherein the &' is taken equal to an oscillation amplitude of the internal cone 2, and FIG. 2 shows this relationship.

Figure 3:
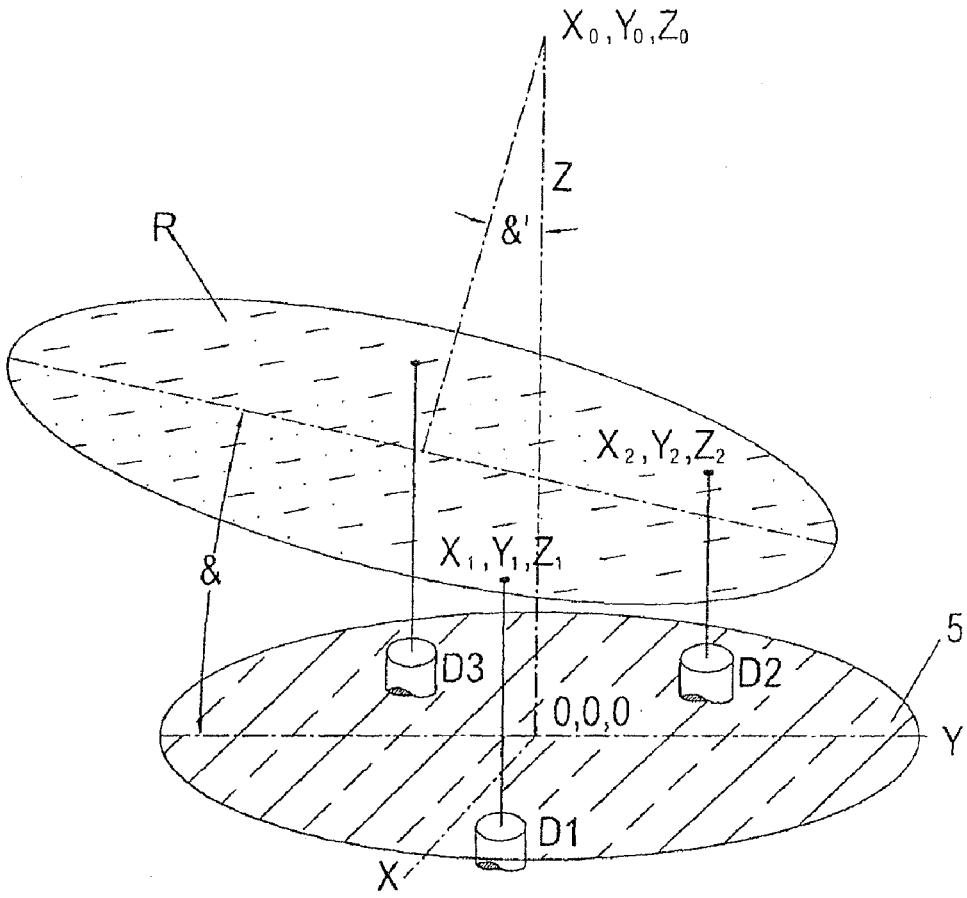
FIG. 3 explains a mathematical principle for calculating parameters.

Let us consider a particular example of calculating a position of the disc R plane under a condition that all sensors D 1, 2 and 3 are in the same horizontal plane; FIG. 3 shows explanatory drawings.

A coordinate origin (0, 0, 0) is in the plane where the sensors D arranged, particularly at a point where it crosses with the rotation axis Z of the unbalanced vibrator 1 (the vertical axis of symmetry).

In order to improve the angle determination accuracy, a radius of sensor arrangement, that is a distance from the vertical symmetry axis Z of the crusher to a location of a sensor, should a maximum allowable radius.

A position of each sensor is defined by a pair of numbers $(X_i, Y_i)$ while a measurement result is defined by a number Z, that is, the sensors are oriented vertically.

Let us find a plane equation in the form $$A\cdot x+B\cdot y+C\cdot z+D=0$$

in accordance with three points, in other words, according to results of measurements and positions of sensors.

$$A = \mathrm{Det}\begin{vmatrix} Y_1 & Z_1 & 1 \\ Y_2 & Z_2 & 1 \\ X_3 & Z_3 & 1 \end{vmatrix} \tag{2a}$$

-continued $$B = \mathrm{Det}\begin{vmatrix} Z_1 & X_1 & 1 \\ Z_2 & X_2 & 1 \\ Z_3 & X_3 & 1 \end{vmatrix} \tag{2b}$$

$$C = \mathrm{Det}\begin{vmatrix} X_1 & Y_1 & 1 \\ X_2 & Y_2 & 1 \\ X_3 & Y_3 & 1 \end{vmatrix} \tag{2c}$$

$$D = \mathrm{Det}\begin{vmatrix} X_1 & Y_1 & Z_1 \\ X_2 & Y_2 & Z_2 \\ X_3 & Y_3 & Z_3 \end{vmatrix}. \tag{2d}$$

The angle of inclining the plane relative to horizontal is found from the determined coefficients $$\&=\mathrm{ArcCos}[C/sqrt(A^2+B^2+C^2)].$$

The found angle determines the oscillation amplitude of the internal cone 2.

The size of the discharge gap 4 is calculated by the central computer in accordance with the found value of the oscillation amplitude of the internal cone 2.

The obtained size of the discharge gap 4 is compared to a predetermined parameter in the central computer, and a control command is outputted as a result of comparison, said command being to:

- continue the operation if the size of the gap 4 is within a standard;
- or correct the parameters if the size of the gap 4 are beyond the standard;

The main reason to modify the size of the gap is wear of the working surfaces of the cones.

Correction of Parameters

The sensor D 4 continuously radiates USPs vertically towards the flange of the adjustment ring 7 and measures a distance S between the flange of the body 6 and the flange of the adjustment ring 7.

Having made a decision to correct parameters, the central computer gives the control command to the hydraulic cylinders 10, and a pressure therein simultaneously drops, a tension of the stems 11 is reduced, a thread 12 is relaxed, and the adjustment ring 9 turns in the thread 12 under action of the centrifugal force applied to the external cone 3. The cone lowers, the distance S and the size of the discharge gap are decreased. Accordingly, the oscillation amplitude of the internal cone 2 is modified.

As a result of the next cycle of measuring the modified oscillation amplitude of the internal cone 2 and with the proviso that amplitude parameters came within a standard, the central computer gives a control command to interrupt correction.

In this case, the command arrives at the hydraulic cylinders 10, the pressure therein is elevated, the tension of the stem 11 increases, the thread 12 is tightened, the turn of the adjustment ring 9 is stopped. New distance S is fixed by the sensor D4 and memorized, in other words, is set as new parameter corresponding to an optimal size of the discharge gap.

Operation of the sensor D4 serves as an additional protection against an emergency situation when the adjustment ring 9 could spontaneously turn because of relaxing the tension of the thread 12. This situation may be caused, for example, by unauthorized pressure drop in the hydraulic cylinders 10, the elevated level of vibration, or other working reasons.

One of the main advantages of the present method is continuity of measurements. Measurements are cyclic, the frequency and accuracy of measurements are determined by the operation speed of the ultrasonic sensors D. In practice, it was established that it would be reasonable to establish an ultrasound pulse radiation frequency close to the rotation frequency of the unbalanced vibrator of the crusher.

In order to determine a position of the internal cone in the quiescent state, the first cycle of measurement takes place yet before the crusher operation.

The next cycle of measurements takes place immediately after bringing the crusher into the idle mode; this allows additional prevention of the emergency situation. Further, measurements are continuous during operation of the installation. The final cycle of measurement takes place after complete stoppage of the machine.

The distinguishing features of the method make it possible not only to solve the problems posed above but also gain the additional positive effects:

more fine and accurate correction of parameters;

safe operation at a maximum allowable size of the discharge gap;

accumulation of statistics with respect to wear of working surfaces of the cones depending upon a source material and other reasons;

prediction of service life and need of replacement of working assemblies of the machine on the basis of said statistics and using special software of the central computer.

Presence of the automated computer control allows the operator to control the crusher both directly from the place where it operates and remotely from any distant point.

Implementation of the method allows improvement in the crushing installation operation effectiveness at least by 30%.

The invention claimed is:

1. A method for controlling process parameters of a cone crusher comprises:

providing the crusher with sensors;

estimating a size of a discharge gap between external and internal cones;

adjusting the size of the discharge gap using hydraulic cylinders modifying a position of the external cone relative to the internal cone by means of a adjustment ring;

the method being characterized by:

using sensors measuring a distance as said sensors;

controlling the operation of all sensors mounted on the crusher by a program algorithm of a central computer;

rigidly securing a measurement disc R to an unbalanced vibrator in such a manner that a plane of the disc R is always perpendicular to a rotation axis of the unbalanced vibrator, mounting at least two distance measurement sensors on a body of the crusher in such a manner that the disc R in any time is within a working effective zone of the distance sensors;

measuring a distance from each of the measurement sensors to the disc R and calculating a three-dimensional position of the plane of the disc R, wherein an angle & of deviation of the plane of the disc R from horizontal determines an angle &' of deviation of the internal cone from vertical according to which an amplitude of circular oscillations of the internal cone is determined;

determining the size of the discharge gap from the amplitude of circular oscillations;

comparing the obtained size of the discharge gap to a predetermined parameter of the gap in the central computer;

if correction of parameters is necessary as a result of comparisons, outputting a control command to the hydraulic cylinders by the central computer to modify a positions of the adjustment ring;

as the discharge gap achieves the predetermined parameter, outputting a control command to the hydraulic cylinders by the central computer to stop modification of the position of the adjustment ring;

monitoring the modification of the position of the adjustment ring using at least one distance monitoring sensor which is mounted at a flange of a top part of the body within an opening between the flange of the body and a flange of the adjustment ring of the external cone;

measuring a distance S between the flange of the body and the flange of the adjustment ring and supplying information to the central computer and comparing it to previous measurements;

simultaneously, by the central computer, monitoring a wear of working surfaces of the cones in such a manner that a minimum wear corresponds to a minimum value of the S while a maximum wear corresponds to a maximum value of the S, and outputting a command to stop operation and replace the cones when the S achieves a critical value;

simultaneously, by the central computer, monitoring a spontaneous turn of the adjustment ring that shows an unauthorized variation of the distance S because of relaxing a thread tension, wherein all said measurements take place continuously, cyclically, in the operation mode, in the idle mode, and in the quiescent state.

2. A method according to claim 1, characterized in that ultrasonic and/or laser sensors are used as the distance sensors.

3. A method according to claim 1, characterized in that the measurement disc R is fastened to an end face of a casing of a sliding bearing in the unbalanced vibrator of the cone crusher in such a manner that the plane of the disc R is parallel to a plane of a base of the internal cone.

4. A method according to claim 2, characterized in that the measurement disc R is fastened to an end face of a casing of a sliding bearing in the unbalanced vibrator of the cone crusher in such a manner that the plane of the disc R is parallel to a plane of a base of the internal cone.

* * * * *